United States Patent [19]

Sabet et al.

[11] 4,370,109

[45] Jan. 25, 1983

[54] ROTARY PISTON-INTERNAL COMBUSTION ENGINE HAVING A CENTRAL AXIS

[75] Inventors: Huschang Sabet, Eduard-Pfeiffer-Str. 67, Stuttgart, Fed. Rep. of Germany; Dietrich Eckhardt, Aichwald, Fed. Rep. of Germany

[73] Assignee: Huschang Sabet, Stuttgart, Fed. Rep. of Germany

[21] Appl. No.: 237,065

[22] Filed: Feb. 23, 1981

[30] Foreign Application Priority Data

Feb. 25, 1980 [DE] Fed. Rep. of Germany ..... 3006940

[51] Int. Cl.[3] ..... F02B 55/14; F01C 1/00

[52] U.S. Cl. ..... 418/34; 123/43 B

[58] Field of Search ..... 418/33, 34; 123/43 B, 123/245

[56] References Cited

U.S. PATENT DOCUMENTS

| | | | |
|---|---|---|---|
| 3,779,215 | 12/1973 | Sabet | 418/34 |
| 3,953,157 | 4/1976 | Sabet | 418/34 |
| 4,009,691 | 3/1977 | Sabet | 418/33 |
| 4,169,697 | 10/1979 | Doundoulakis | 418/34 |

FOREIGN PATENT DOCUMENTS

| | | | |
|---|---|---|---|
| 12329 | 6/1980 | European Pat. Off. | 418/34 |
| 2902915 | 7/1980 | Fed. Rep. of Germany | 418/33 |
| 787880 | 9/1935 | France | 418/34 |
| 1028098 | 5/1966 | United Kingdom | 123/245 |

*Primary Examiner*—P. S. Lall

*Attorney, Agent, or Firm*—Toren, McGeady and Stanger

[57] ABSTRACT

A rotary piston-internal combustion engine has a stationary engine housing with a central axis. A rotor is positioned within the housing and includes a cylinder with first pistons integral with and spaced uniformly apart around the inner surface of the cylinder. The first pistons are sector-shaped. The rotor rotates at a constant velocity. A hub is located within the cylinder coaxial with the central axis and can rotate relative to the cylinder and first pistons. Second pistons are fixed to the hub and each extends radially outwardly from the hub between a pair of adjacent first pistons. Openings extend through the cylinder and are arranged symmetrically relative to axially extending central plane of the first pistons. Seals are provided around the openings between the outside surface of the cylinder and the interior of the housing.

7 Claims, 4 Drawing Figures

ROTARY PISTON-INTERNAL COMBUSTION ENGINE HAVING A CENTRAL AXIS

SUMMARY OF THE INVENTION

The present invention is directed to a rotary piston-internal combustion engine having a circular stationary casing with a central axis. A rotor connected to a driven shaft rotates within the housing at a constant velocity. The rotor is made up of a cylinder and end face members or discs extending transversely of the central axis. The cylinder has inlet and outlet openings extending through it and the openings are uniformly distributed around its periphery. Extending radially inwardly from the inner surface of the cylinder are first pistons. A hub is rotatably mounted within the cylinder so that it is rotatable relative to the cylinder. Second pistons are secured to and extend outwardly from the hub with each second pistons located between a pair of first pistons. Working chambers are located within the cylinder.

Internal combustion engines of this type, such as German Offenlegungsschrift No. 2 107 137, are constructed to avoid the disadvantage of known internal combustion engines which operate according to the so-called "cat and mouse principle." The disadvantage of such engines is that all of the parts must be sealed, that is, the two pistons must be sealed with respect to one another and also with respect to the housing. Such sealing requirements result in considerable difficulties because of existing sealing boundaries, lines, cracks or the like, or interrupted sealing boundaries.

It is suggested in this internal combustion engine, which has four working chambers, to provide the slots arranged in the cylinder casing on both sides of each piston connected with the casing. The slots are arranged in two radial planes so that in the housing shell inlet and outlet slots are provided and are arranged offset at an angle of approximately 90° with respect to the corresponding slots of the other radial plane.

In the design of a rotary piston-internal combustion engine having a central axis of the type described above which is intended to be an engine with a high power and with a simplified construction as compared to the known constructions, it is the primary object of the present invention to maintain the length of the sealing boundaries as small as possible while limiting, as much as possible, the number of structural parts which rotate relative to one another. Moreover, the arrangement of the cylinder openings is provided to achieve a simplified control and also to afford favorable conditions in the combustion chamber and to provide for a high compression and optimum combustion of the fuel.

In accordance with the present invention, the first pistons fixed to the cylinder are sector-shaped and the openings through the cylinder are located in the angular range of the sector-shaped pistons with the first pistons forming depressions aligned with the openings so that the depressions or recesses form combustion chambers.

In U.S. Pat. No. 1,481,220 another internal combustion engine of the type mentioned above, is illustrated. This engine, however, has a pair of pistons connected with the cylinder and has only two working chambers with two spark plugs in the chambers arranged diametrically opposite one another in the transversely extending end face surfaces of the cylinder. These spark plugs are ignited only once during one rotational cycle of the cylinder by a contact arranged in the engine frame. The inlet and outlet slots in the cylinder surface extend over the entire length of the cylinder.

In accordance with the present invention, the construction of the internal combustion engine mentioned above is significantly simplified. The overall length of the sealing boundaries or lines is shortened and the seals are subjected to less wear. Further, the surfaces along which the seals are located have no local temperature peaks, but instead have a more uniform temperature due to the cooling action resulting from the gas change in a four-stroke operation.

As a result of the arrangement of the pistons secured to the rotating cylinder, the arrangement of the end face members or portions of the rotor has proven to be particularly advantageous for reducing the number of seals and for avoiding the presence of splash oil in the gear assembly.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAIL DESCRIPTION OF THE INVENTION

Figure 1:
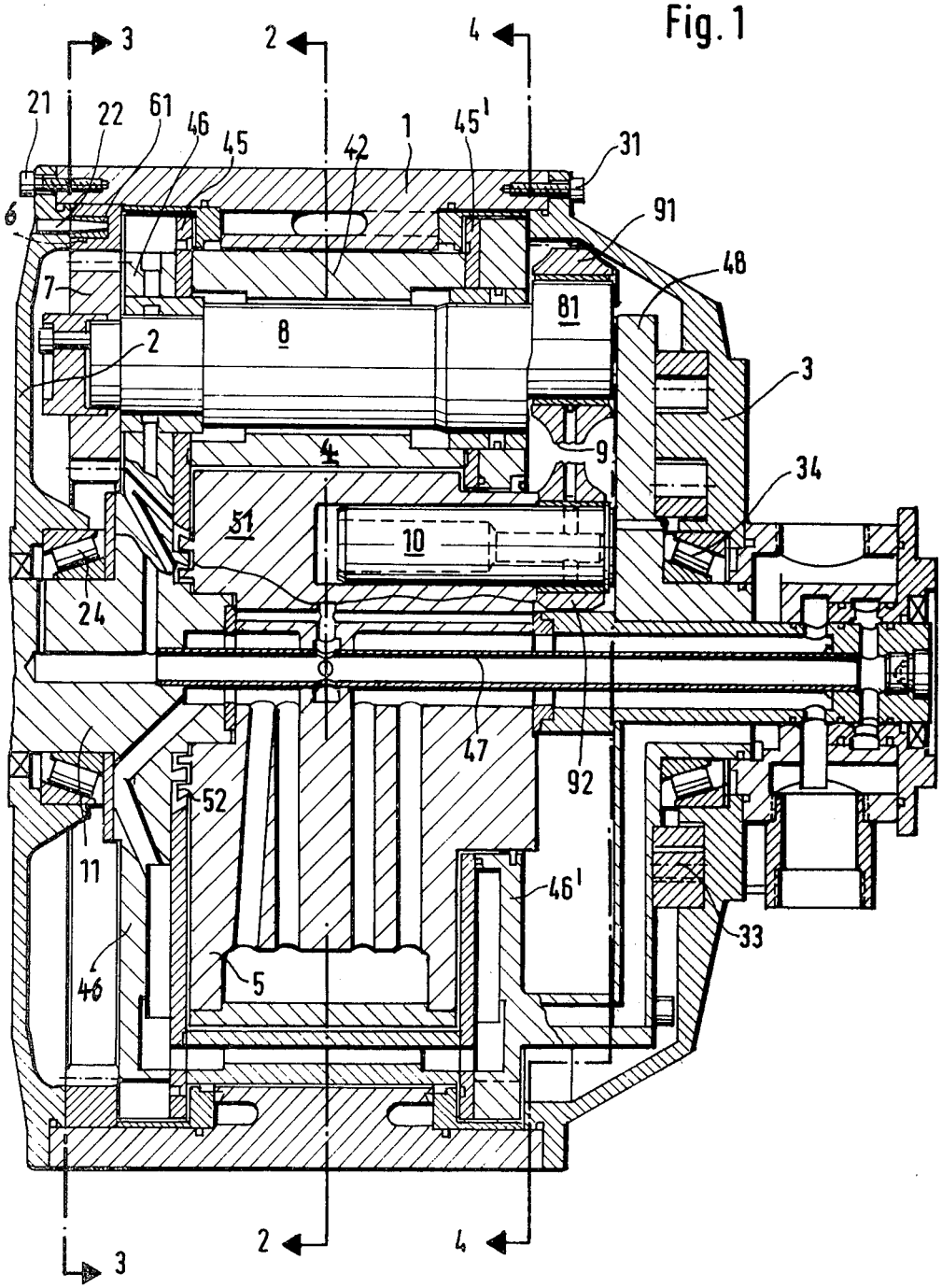
FIG. 1 is an axially extending sectional view of a rotary piston-internal combustion engine embodying the present invention with the section being taken along the line 1—1 shown in FIG. 2.
Figure 2:
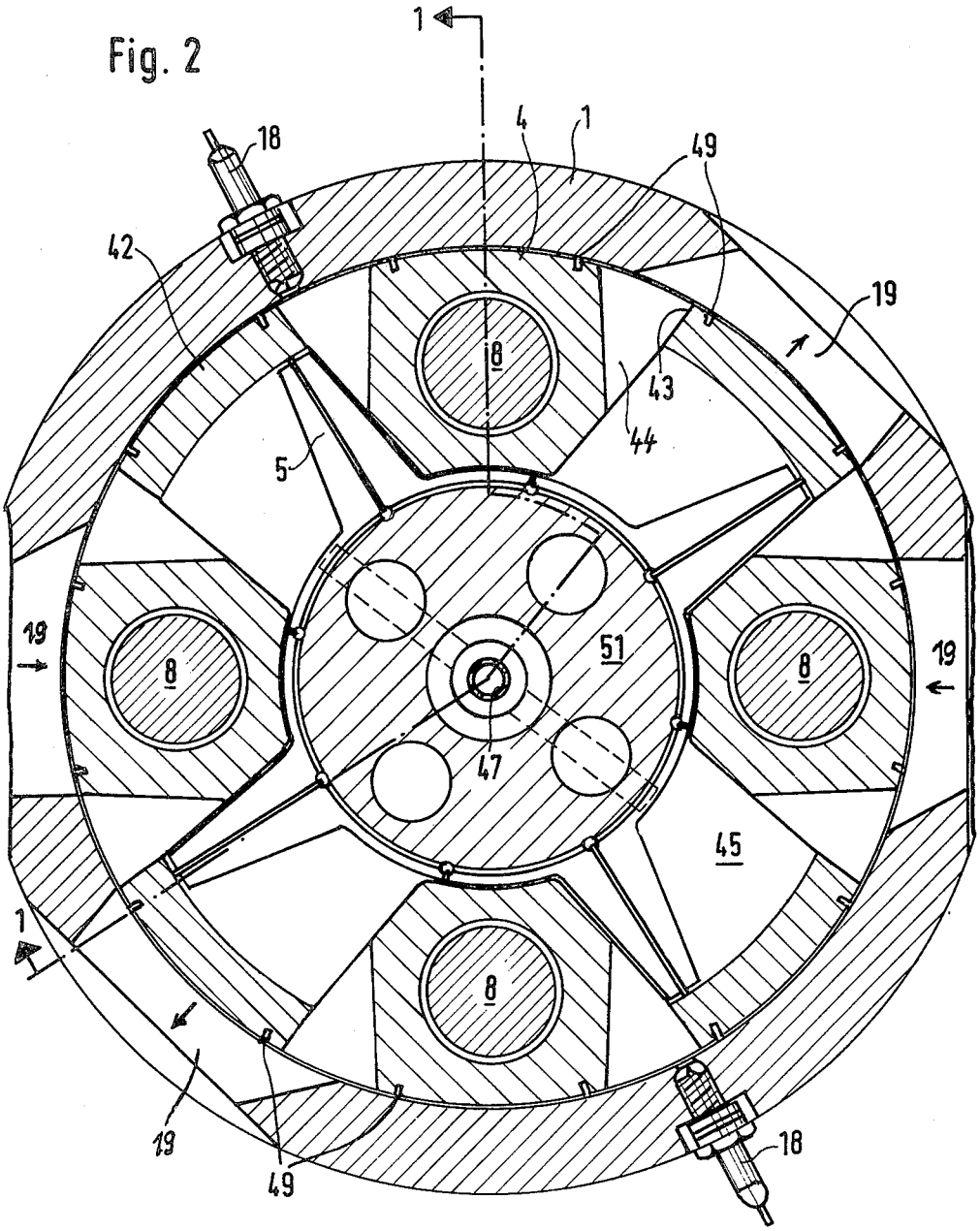
FIG. 2 is a transverse sectional view along the line 2—2 in FIG. 1 displaying the engine housing with the pistons rotating within the housing.
Figure 3:
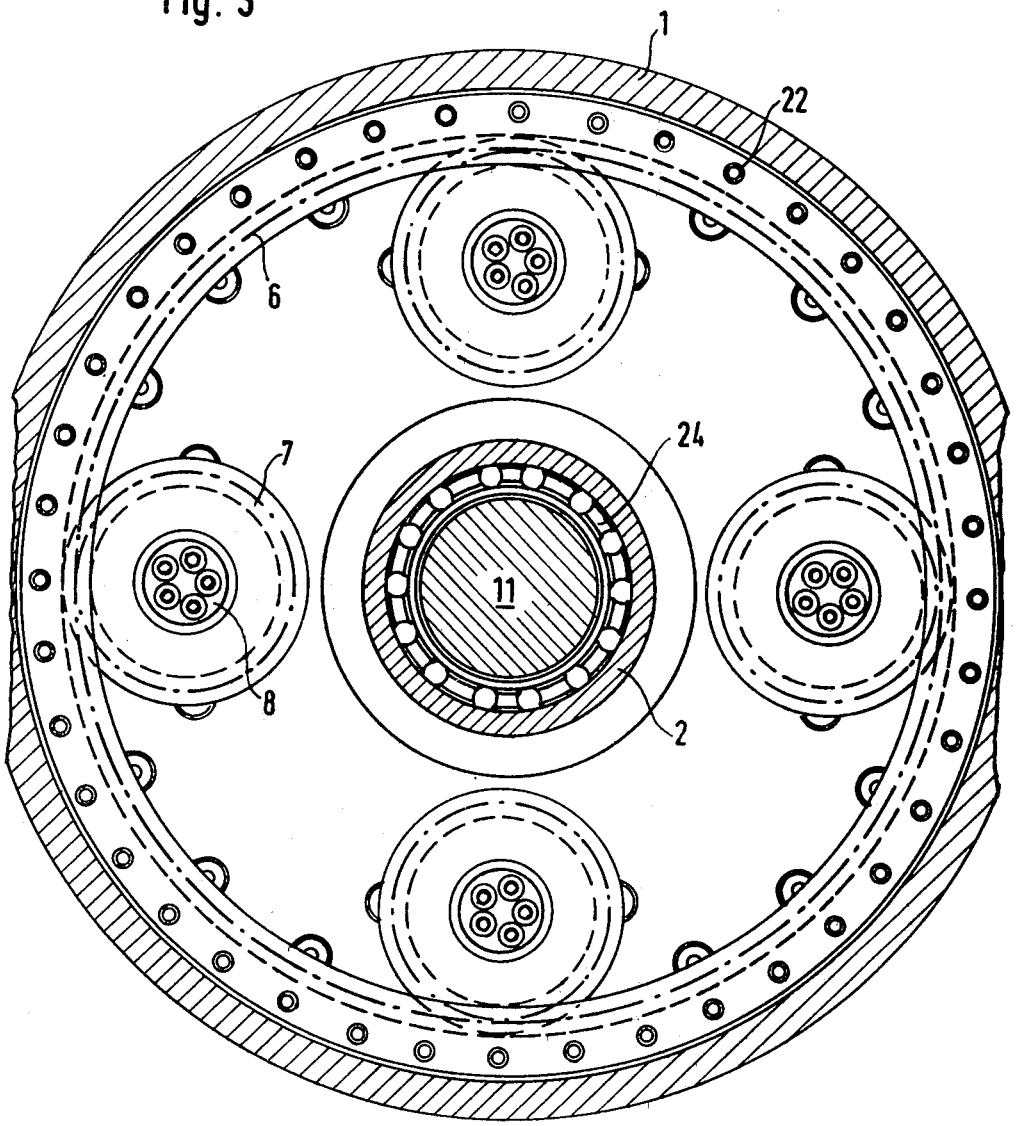
FIG. 3 is a transverse sectional view taken along the line 3—3 in FIG. 1.
Figure 4:
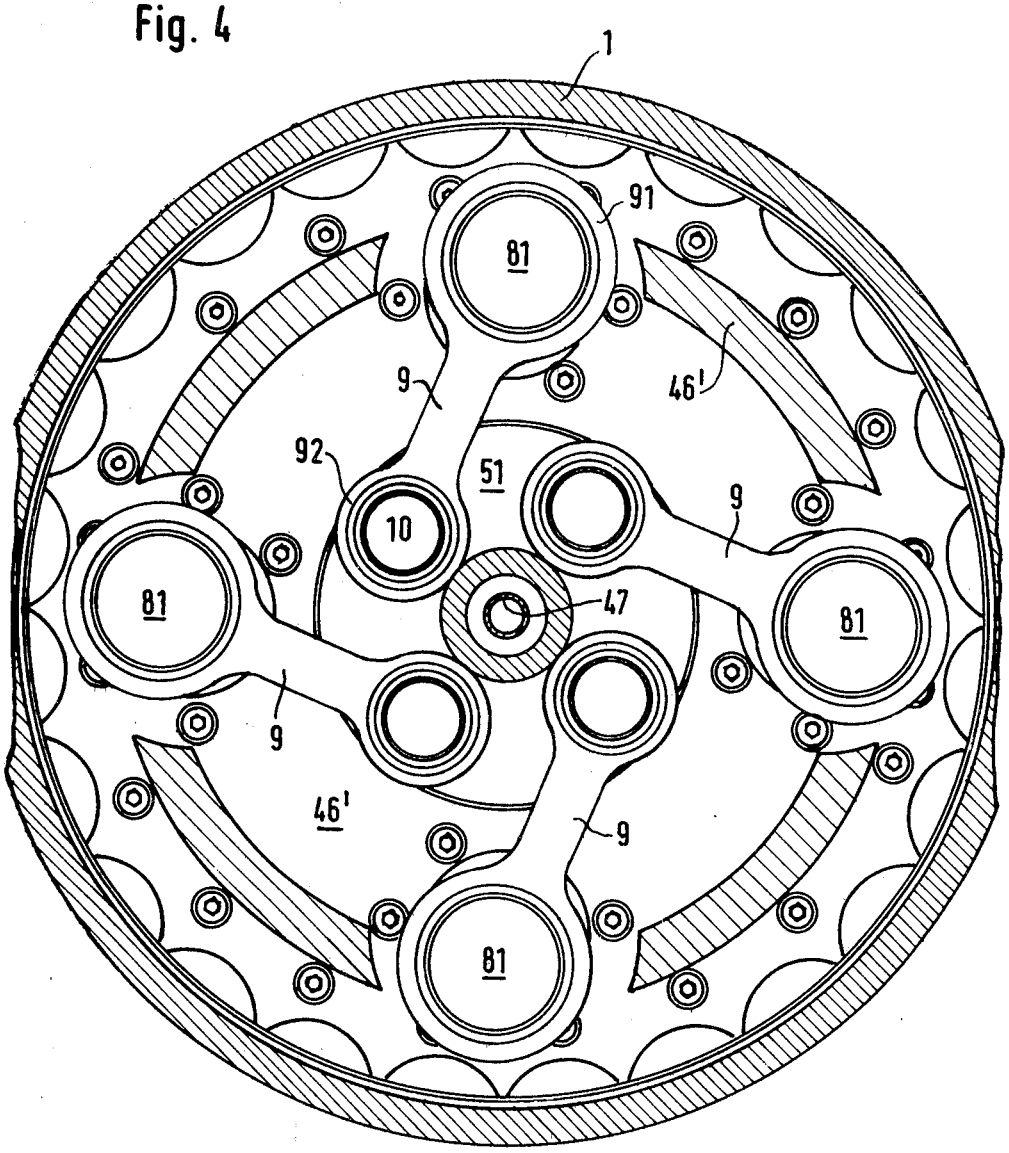
FIG. 4 is another transverse sectional view taken along the line 4—4 in FIG. 1.

In the drawings a cylindrically shaped stationary engine housing is formed by a cylindrically shaped part 1 and two end parts or covers 2 and 3. The housing part 1 has a pair of diametrically opposed threaded bores each containing a spark plug 18. Openings are provided through the housing part 1 for the inlet of the fuel mixture and the outlet of the exhaust gases, note the arrows showing the direction of flow through the openings. A rotor is mounted within the housing for rotation about its central axis. The rotor includes a cylinder 42 with the outer surface of the cylinder in closely spaced sliding engagement relative to the inner surface of the housing part 1. Four pistons 4 are formed integrally with and project radially inwardly from the inner surface of the cylinder. The pistons 4 are sector-shaped and are uniformly spaced around the cylinder so that the axially extending flanks of the pistons are in angularly spaced relationship to one another. Working chambers are provided within the cylinder 42 defined transversely of the central axis of the housing by inner discs 45, 45' rigidly connected with the pistons 4. An outer end face disc 46, 46' is positioned in contact with each of the inner discs 45, 45'. These contacting discs define the opposite ends of the work chambers. As can be seen in FIG. 1, these inner and outer discs have bores or combine to form openings which provide lubricating oil ducts which are interconnected by cooling oil ducts 47. Further, the working chambers are bounded in the axial direction of the engine by the radially extending flanks or sides of the pistons 4. Within the working chambers, pistons 5 can rotate at a variable velocity relative to the constant velocity of the pistons 4. Accordingly, the pistons 5 can rotate relative to the pistons 4. As can be seen in FIG. 2, pistons 5 have a smaller mass than the piston 4. The pistons 5 are formed integrally with an axially extending hub 51 which extends coaxially with the central axis of the housing. A driven shaft 11 is constructed as a unit with the outer disc 46 and it provides an end support for the hub 51 and the pistons 5. In FIG. 3 planet wheels 7 are shown in meshed engagement with inner gear wheels 6 elastically connected with the cover shell or part 2 and disposed inside the housing part 1. Each planet wheel 7 is connected to a shaft 8 with each shaft 8 extending through a different one of the pistons 4. The shafts are supported in the end face discs 46, 46'. The opposite end of the shaft 8 from the planet wheel 7 has an outside crank with a short crank pin 81. Crank pin 81 fits in a bearing 91 of a connecting rod 9, note FIG. 4. The other end of the connecting rod 9 forms a bearing 92 positioned on a bolt 10 placed eccentrically on the hub 51 of the pistons 5.

The resilient support of the inner gear wheel 6 is afforded by elastic sleeves 61 inserted in the end face of the outer region of the inner gear wheel 6 with bolts 22 extending through the housing part 2 into the sleeves. Housing part 2 is connected by means of threaded bolts 21 to one end of the cylindrical housing part 1 while threaded bolts 31 secure the other housing end part 3 to the housing part 1.

At the crank gear end of the housing, a bearing flange 48 is connected with the outer disc 46' and the end face of this bearing flange forms, together with the housing end part 3, a housing for a gear pump 33 constructed as a crescent-shaped pump. The rotor parts which rotate at a uniform velocity are supported in end bushings 24, 34 in the housing end parts 2, 3, respectively. The bushing 24 is supported on the driven shaft 11 while the bushing 34 is mounted on the bearing flange 48.

As can be seen in FIG. 2 openings 43 extend through the cylinder 42 in the angular range of the sector-shaped pistons 4. Sealing rings 49 fitted in the outer surface of the cylinder 42 encircle the openings 43 and seal the passages formed by the openings to the working chambers. Lubricating oil is conducted directly to the bearings 24, 34 and to the bearings of the crankshafts 8 and is conducted indirectly to the bearings of the connecting rods 9 through the duct 47 via ducts or passageways arranged in the hub 51 and the bolts 10. To prevent oil from reaching between the end faces of the smaller pistons 5 and the inner disc 45, 45' at the end faces which limit the working chambers, annular ledges or projections are provided on the end face of the hub 51 and these projections fit into circumferential grooves in the juxtaposed end face surface of outer disc 46 or they interact with annular projections in this disc. The flanks of these annular projections form an acute angle with the rotational axis of the pistons 4, 5 and limit oil drainage ducts which are directed radially outwardly in the direction of the housing end part 2 so that the oil present in these areas is displaced outwardly. The cooling oil flows through the ring-shaped cylindrical duct surrounding the axial tube 47 and flows into the cooling coils provided in the smaller pistons 5 and also passes into the ducts formed between the inner and outer discs 45, 46 and 45', 46' in the end faces of the cylinder. Flow also is conducted to the cooling ducts arranged in the cylinder 42 in the form of helical windings. At the locations where it is possible that oil may be pulled along by the gas flow, labyrinth arrangements are provided in a known manner to calm and reduce the gas flow.

As can be seen in FIG. 1, inner discs 45, 45' have a larger outside diameter than the outside diameter of the cylinder 42 so that splashing oil is kept out of the gearing chamber and cannot reach the inlet openings and outlet openings 19. The outer discs 46, 46' have ribs at their periphery which transport the oil from the gear chamber into tangentially open outlet ports, not shown, in the housing shell.

Inwardly of the openings 43 through the cylinder 42, the portions of the pistons 4 aligned with the openings form combustion chamber troughs or recesses 44. These recesses converge inwardly toward the center of the cylinder. These combustion chamber troughs open into the working chambers.

While specific embodiments of the invention have been shown and described in detail to illustrate the application of the inventive principles, it will be understood that the invention may be embodied otherwise without departing from such principles.

We claim:

1. Rotary piston-internal combustion engine comprising a stationary engine housing having a central axis, a rotor mounted within said housing for rotation at uniform velocity about the central axis relative to said housing, a driven shaft located within said housing and connected to said rotor, said rotor comprising an open-ended cylinder coaxial with the central axis and an end face member located at and extending transversely across each of the opposite ends of said cylinder, said cylinder having inlet and outlet openings therethrough uniformly spaced about the cylindrical periphery thereof, first pistons connected to and extending radially inwardly from the inner periphery of said cylinder, said first pistons being uniformly spaced apart within said cylinder, an axially extending hub located within said cylinder coaxial with the central axis and being rotatable within said cylinder relative to said first pistons, a number of uniformly spaced second pistons corresponding to the number of said first pistons being secured to and rotating with said hub, said cylinder said end face members and said first pistons defining working chambers within said cylinder with each said second piston being positioned within a different one of said working chambers, sealing means located between the radially outer surface of said cylinder and in contact with said housing for providing a seal around said openings through said cylinder, said first pistons being sector-shaped and having generally radially extending flanks with said flanks defining axially extending sides of said working chambers, said openings in said cylinder being located within the angularly extending range of said first pistons and said openings within the angularly extending range of each said first piston being arranged symmetrically relative to the axially extending center plane of said first pistons.

2. Rotary piston-internal combustion engine, as set forth in claim 1, wherein said opening through said cylinder are extended through said sector-shaped first pistons by radially inwardly narrowing recesses formed in the flanks of said pistons with said recesses forming combustion chambers.

3. Rotary piston-internal combustion engine, as set forth in claim 1, wherein the radially outside surfaces of said end face members project radially outwardly beyond the outside surface of said cylinder and form a narrow gap with said stationary housing.

4. Rotary piston-internal combustion engine, as set forth in claim 3, wherein said radially outside surface of said end face members having ribs extending therefrom for directing oil in a particular direction.

5. Rotary piston-internal combustion engine, as set forth in claim 3 or 4, wherein said end face members each comprises an inner face disc and an outer face disc with the facing surfaces of said discs being recessed for forming oil cooling ducts and lubricating oil ducts.

6. Rotary piston-internal combustion engine, as set forth in claim 5, wherein the end faces of said hub and of said second piston extending transversely of the central axis of said housing having annular projections thereon, said outer end face disc having a circumferential groove therein for interaction with said annular projection, and the axially extending sides of said annular projections being disposed at an acute angle with the central axis of said housing and said angularly extending flanks defining oil drainage ducts directed radially outwardly in the direction of the adjacent transverse end of said housing.

7. Rotary piston-internal combustion engine, as set forth in claim 1, wherein said first pistons having a larger mass than said second pistons.

* * * * *